US005881338A

United States Patent [19]

Armstrong et al.

[11] Patent Number: 5,881,338

[45] Date of Patent: Mar. 9, 1999

[54] CONTAMINATION CONTROL DEVICE FOR AN ELECTROSTATOGRAPHIC DEVELOPMENT STATION

[75] Inventors: Timothy Gilbert Armstrong, Rochester; James C Maher, North Rose; Susan Pike Farnand, Fairport, all of N.Y.

[73] Assignee: Eastman Kodak Company, Rochester, N.Y.

[21] Appl. No.: 627,321

[22] Filed: Apr. 1, 1996

[51] Int. Cl.[6] ..... G03G 21/00

[52] U.S. Cl. ..... 399/98; 399/99; 399/103; 399/267

[58] Field of Search ..... 399/99, 103, 106, 399/257, 267, 98

[56] References Cited

U.S. PATENT DOCUMENTS

| | | | |
|---|---|---|---|
| 4,377,334 | 3/1983 | Nishikawa | 399/103 |
| 4,583,112 | 4/1986 | Morano et al. | 399/103 |
| 4,634,286 | 1/1987 | Pike | 399/267 X |
| 4,666,282 | 5/1987 | Rowe | 399/103 X |
| 4,963,930 | 10/1990 | Yoshimaru et al. | 399/103 |

FOREIGN PATENT DOCUMENTS

| | | |
|---|---|---|
| 56-46272 | 4/1981 | Japan . |
| 59-224876 | 12/1984 | Japan . |
| 60-474 | 1/1985 | Japan . |
| 63-101873 | 5/1988 | Japan . |
| 1-293371 | 11/1989 | Japan . |

*Primary Examiner*—William Royer
*Attorney, Agent, or Firm*—Lawrence P. Kessler

[57] ABSTRACT

A development station for an electrostatographic reproduction apparatus wherein pigmented marking particles from a particulate material mixture of pigmented marking particles and magnetic carrier particles are utilized to develop latent image charge patterns on a dielectric member. The development station has a housing adapted to be located adjacent to a dielectric member. The housing defines a reservoir for a particulate material mixture, and an opening facing such dielectric member. A mixer for mixing particulate material, a magnetic brush for applying pigmented marking particles from such particulate material mixture to a latent image charge pattern to develop such charge pattern, and a transport for transporting such particulate material from the mixer to the magnetic brush are located within the housing. A device is provided for collecting contaminating airborne particulate material contamination. The contamination collecting device includes an elongated tube, located externally of the housing. The tube defines an opening communicating through the wall of the tube with the interior thereof. Passages are defined by the housing between the magnetic brush and the mixer, communicating with the opening of the tube, and a vacuum is supplied to the interior of the tube to substantially prevent contamination of the reproduction apparatus and its environment.

8 Claims, 3 Drawing Sheets

FIG. 2
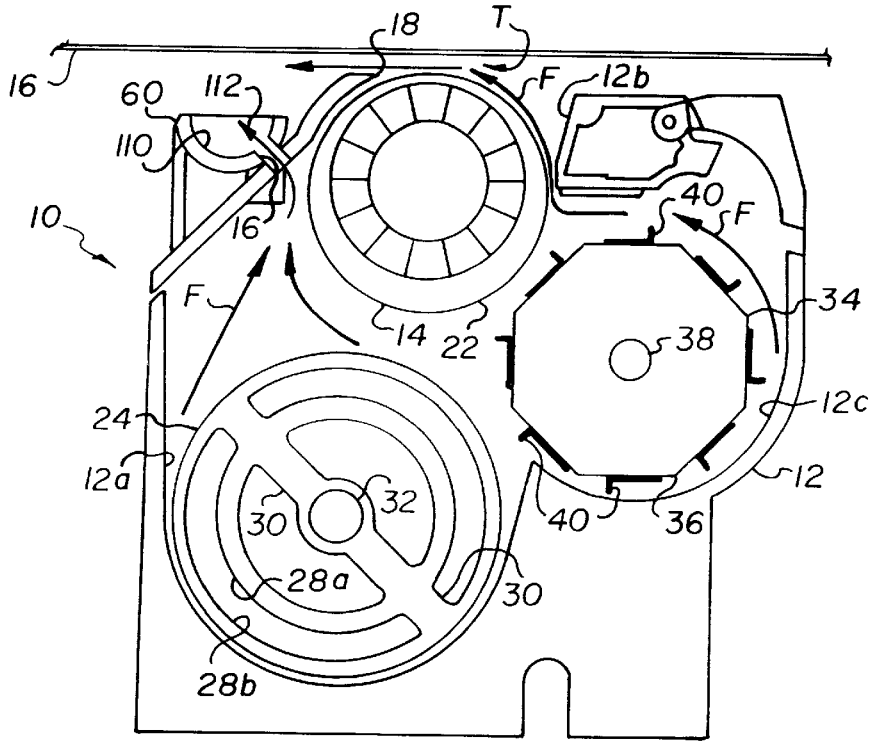
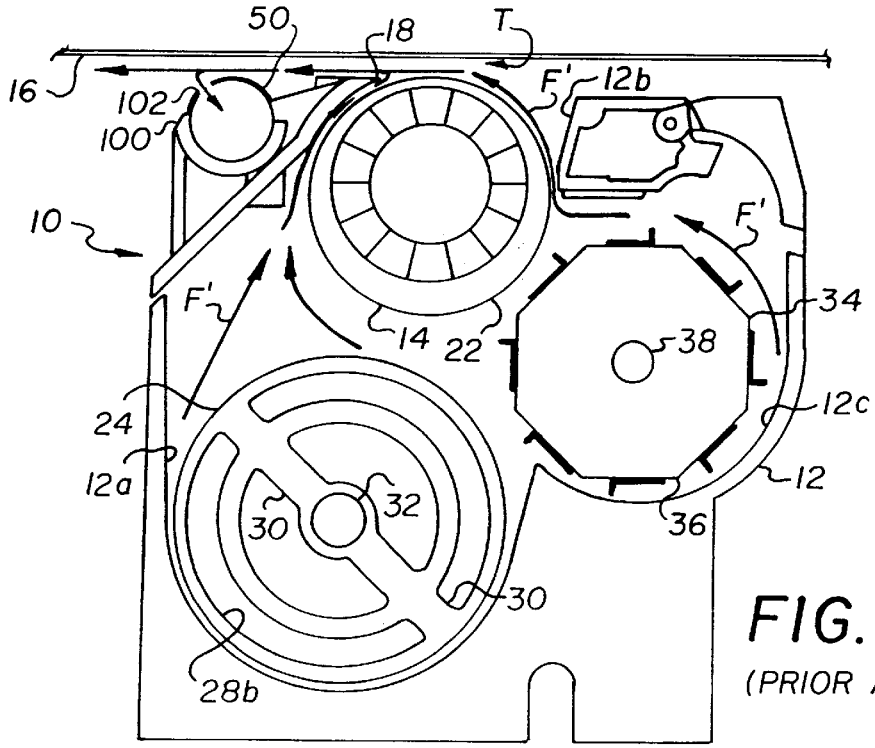
FIG. 3
(PRIOR ART)

CONTAMINATION CONTROL DEVICE FOR AN ELECTROSTATOGRAPHIC DEVELOPMENT STATION

BACKGROUND OF THE INVENTION

The present invention relates in general to control of contamination within the environment of electrostatographic reproduction apparatus, and more particularly to a contamination control device for the development station of the reproduction apparatus.

In typical commercial reproduction apparatus (for example, electrostatographic copier/duplicators, printers, or the like), a latent image charge pattern is formed on a uniformly charged dielectric member. Pigmented marking particles, contained in a development station, are attracted to the latent image charge pattern to develop such image on the dielectric member. A receiver member is then brought into contact with the dielectric member, and an electric field is applied to transfer the marking particle developed image to the receiver member from the dielectric member. After transfer, the receiver member bearing the transferred image is transported away from the dielectric member, and the transferred image is fixed to the receiver member by heat and/or pressure to form a permanent reproduction thereon.

One type of development station commonly used in electrostatographic reproduction apparatus is referred to as a magnetic brush development station. An exemplary magnetic brush development station, such as shown in US Pat. No. 4,878,089 (issued Oct. 31, 1989, in the name of Gustlits et al), includes a housing providing a reservoir for a supply of developer material. The developer material may be, for example, a two component material comprising magnetic carrier particles and relatively smaller pigmented marking particles. A mechanism such as a paddle wheel, auger, or ribbon blender, is located in the reservoir and serves to stir the carrier particles and the marking particles to triboelectrically charge the particles so that the marking particles adhere to the surfaces of the carrier particles. A transport mechanism brings the developer material mixture into the field of a plurality of magnets which, in turn, apply the marking particles to the latent image charge pattern on the dielectric member to adhere to the pattern forming the developed image.

It is well known that while the magnetic brush development station has been perfected to the point where, in general, it is quite efficient in developing latent image charge patterns, it still tends to generate considerable airborne particulate matter. This is due to the high turbulence during mixing and, at least in part, to the fact that during mixing certain particles remain uncharged, receive only a low charge, or acquire a wrong sign charge. These particles readily become airborne rather than flowing with the remaining developer material mixture via the transport mechanism into the magnetic development field.

Such airborne particulate matter, if left uncontrolled, may escape from the developer station and cause the interior of the reproduction apparatus to become contaminated. This can adversely effect the reproduction apparatus causing operating problems and/or degraded copy output. Moreover, the contamination may eventually escape to the environment surrounding the reproduction apparatus and unduly contaminate such environment. Accordingly, certain electrostatographic reproduction apparatus have provided contained exhaust systems operatively associated with the respective development stations. While such systems have been shown to reduce airborne particulate contamination associated with magnetic brush development stations, they are not completely efficient, and thus allow adverse contamination to build up in the reproduction apparatus and its environment.

SUMMARY OF THE INVENTION

In view of the foregoing discussion, this invention is directed to a device for efficiently controlling contamination in a magnetic brush development station for an electrostatographic reproduction apparatus wherein pigmented marking particles from a particulate material mixture of pigmented marking particles and magnetic carrier particles are utilized to develop latent image charge patterns on a dielectric member. The development station has a housing adapted to be located adjacent to a dielectric member. The housing defines a reservoir for a particulate material mixture, and an opening facing such dielectric member. A mixer for mixing particulate material, a magnetic brush for applying pigmented marking particles from such particulate material mixture to a latent image charge pattern to develop such charge pattern, and a transport for transporting such particulate material from the mixer to the magnetic brush are located within the housing. A device is provided for collecting contaminating airborne particulate material contamination. The contamination collecting device comprises an elongated tube, located externally of the housing. The tube defines an opening communicating through the wall of the tube with the interior thereof. Passages are defined by the housing, between the magnetic brush and the mixer, communicating with said opening of the tube, and a vacuum is supplied to the interior of the tube to substantially prevent contamination of the reproduction apparatus and its environment.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 2 is a front elevational view of the development station and contamination control device of FIG. 1, in cross-section, with portions broken away to facilitate viewing;

FIG. 3 is a front elevational view, similar to FIG. 2, of a development station and contamination control device of the prior art, in cross-section, with portions broken away to facilitate viewing;

DETAILED DESCRIPTION OF THE INVENTION

Figure 1:
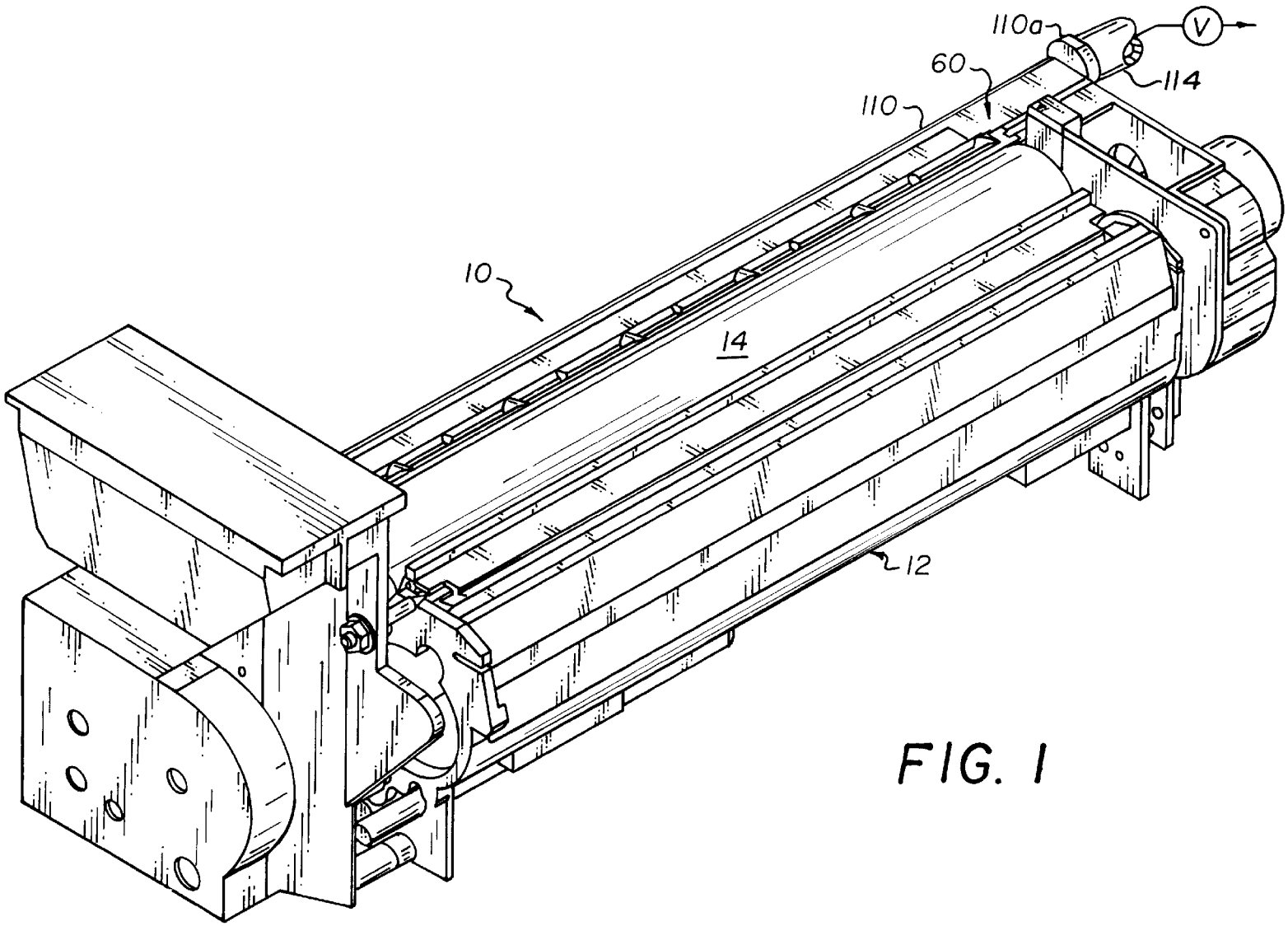
FIG. 1 is a view, in perspective, of a development station, for an electrostatographic reproduction apparatus, including a contamination control device according to this invention.

Referring now to the accompanying drawings, FIGS. 1 and 2 show a typical magnetic brush development station (such as the development station shown and described in the aforementioned US Pat. No. 4,878,089), designated generally by the numeral 10, for an electrostatographic reproduction apparatus. The development station 10, described herein to the extent necessary for a full understanding of the instant invention, includes a housing 12 having intercommunicating portions 12*a*–12*c* including a lower portion 12*a* which serves as a reservoir for developer material. The developer material is, for example, a two-component material having magnetic carrier particles intermixed with relatively smaller pigmented marking particles. The upper portion 12*b* of the housing 12 contains a magnetic brush 14 for applying the pigmented marking particles to latent image charge patterns respectively formed on a dielectric member 16 moving along a path in juxtaposition to an opening 18 in the upper housing portion 12*b*.

The magnetic brush 14 includes a core 20 having a plurality of magnets spaced around the peripheral surface of the core. A nonmagnetic substantially cylindrical shell 22 surrounds the core 20 and has its longitudinal axis offset from the longitudinal axis of the core. Such offset has the effect of decreasing the field strength of the core magnets over the area of the shell 22 spaced farther from the magnets so that the particulate developer material mixture has less propensity to adhere to the shell in that area and returns to the reservoir. Of course, in other magnetic brush development station arrangements, the core and shell may be concentrically aligned.

As is well known in the art, the core and/or shell can be fixed or rotatable as long as the particular arrangement causes the particulate developer material mixture to move in the fields of the core magnets into contact with the dielectric member 16. In the exemplary magnetic brush development station 10 as illustrated in FIG. 1, the core 20 (and the magnets) rotates clockwise, while the shell 22 rotates counterclockwise. A latent image charge pattern on the dielectric member attracts marking particles from the developer material mixture into adhering relationship with the charge pattern to develop such pattern. The developed pattern can then be subsequently transferred to a final receiver sheet and fixed thereto by heat and/or pressure, or may be fixed directly on the dielectric member.

The particulate developer material mixture within the reservoir formed by the housing portion 12*a* is stirred by a mixer 24. The mixer 24 is, for example, a ribbon blender. The ribbon blender includes an inner helical ribbon 28*a* and an outer helical ribbon 28*b* connected by means of rods 30 to a shaft 32. The shaft 32 is supported in the housing 12 for rotation about the longitudinal axis of such shaft. The pitch of the respective ribbons 28*a*, 28*b* are of opposite hand so that, as the shaft 32 rotates the ribbons, the particulate developer material mixture is moved in opposite directions along the length of the blender, and the material is agitated to provide a triboelectric charge which causes the marking particles to adhere to 0the carrier particles. Of course, other types of mixers, such as paddle wheels or augers for example, are suitable for use with this development station.

The mixer 24 also moves the particulate developer material mixture radially with respect to the mixer so that the material is moved into the portion of the housing 12 designated by the numeral 12*c*. A transporting mechanism 34 is located within the housing portion 12*c*. The mechanism 34, which serves to transport developer material into the field of the magnets of the core 20 of the magnetic brush 14, includes a roller 36. The roller 36 is mounted on a shaft 38 which is, in turn, rotatably supported in the end portions of the housing 12 (only one end shown in FIG. 1). A plurality of pickup members 40 are supported by the roller 36. The pickup members 40, which are located about the periphery of the roller 36 and extend respectively along the full length thereof, are in the general shape of buckets. As the roller 36 is rotated, the pickup members move through the particulate developer material mixture and pick up material. Such material is held until the developer material is in the magnetic field of the magnets of the core 20 of the brush 14. The material is then readily attracted to the shell 22 of the magnetic brush. The particulate developer material mixture is then moved by the magnetic brush 14 in an airstream flow (designated by the letter F in FIG. 2) into applying relation with the charge pattern bearing member 16 in the well known manner to develop the latent image charge pattern on such member.

As noted above, magnetic brush development stations, such as the exemplary station 10, tend to promote the formation of airborne particulate material, in part in the form of uncharged, low charged, and wrong sign toner particles. One prior art device directed at preventing contamination by particulate material from a typical magnetic brush development station is shown in FIG. 3. Such device, designated by the numeral 50, includes an elongated tube 100 attached to the outer portion of the housing 12 of the development station 10. The tube 100 has a plurality of ports 102 (only one shown in FIG. 3) communicating with the interior of the tube, and located at spaced intervals along a longitudinal element of the tube. The tube is coupled to a vacuum source (not shown) to draw air into the tube through the ports. The ports 102 are directed toward the dielectric member 16 downstream, in the direction of travel of the dielectric member, of the toning zone T where development of the latent image charge pattern takes place. The airstream of particulate material flow for this arrangement is particularly shown in FIG. 3 as designated by the letter F'. As can be readily appreciated, particulate material in the airstream flow F' has already left the confines of the development station housing 12 prior to the attempt at capture of the particulate material provided by the vacuum supplied to the tube 100. Accordingly, while a considerable amount of particulate material is captured and removed through the tube, a significant portion may still escape with the airstream into the reproduction apparatus and its environment.

Figure 4:
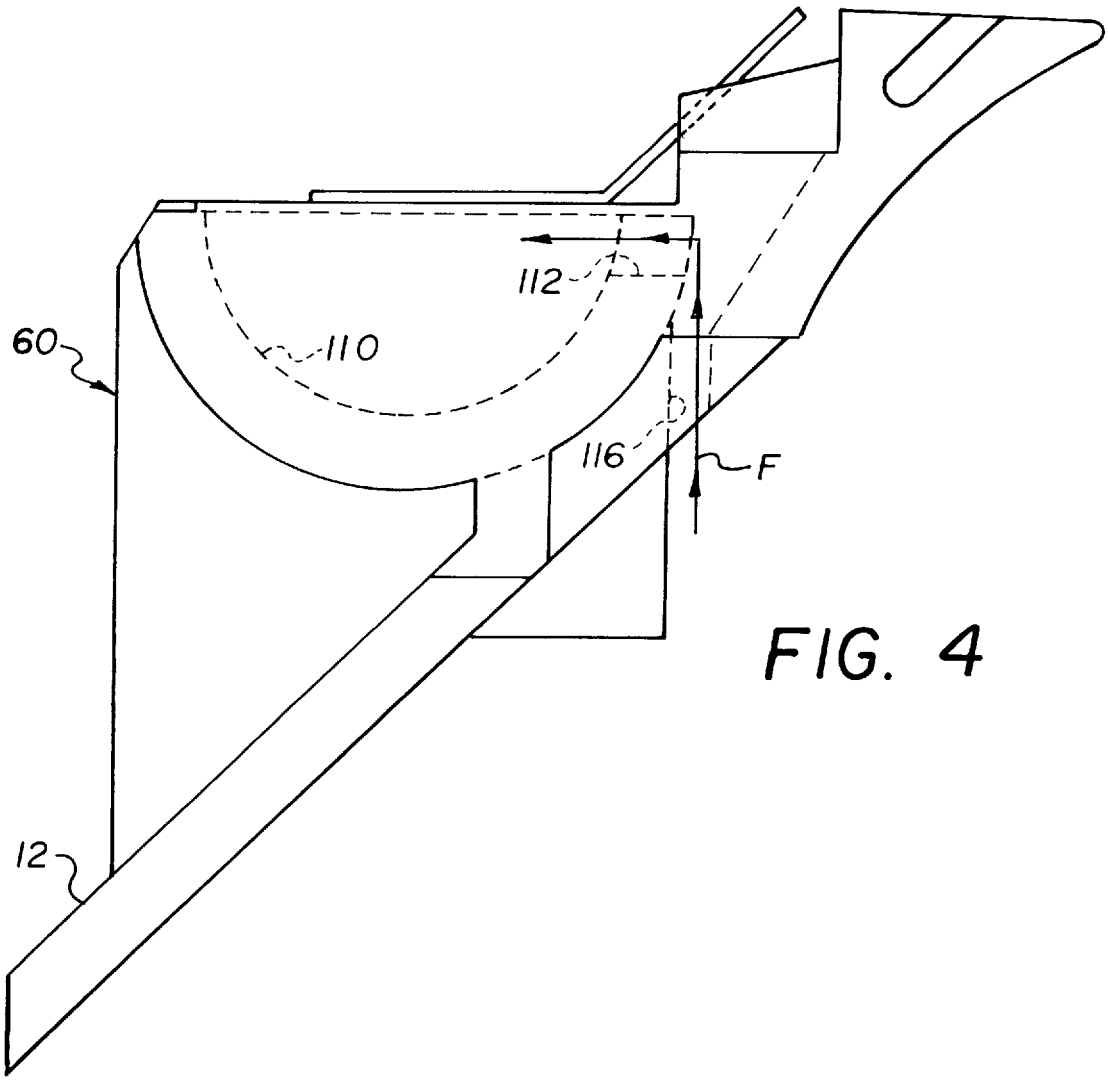
FIG. 4 is a front elevational view, in cross-section and on an enlarged scale, of the contamination control device according to this invention.
Figure 5:
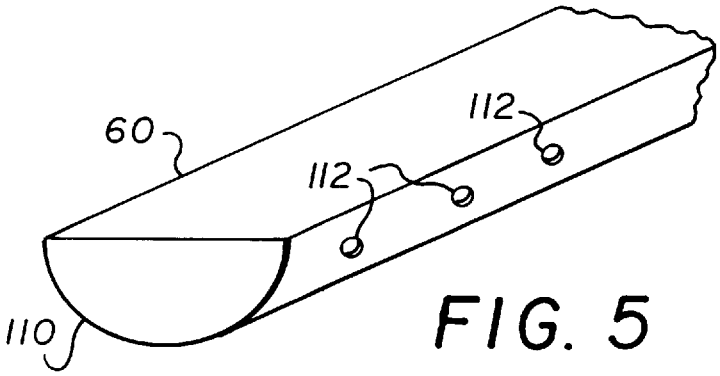
FIG. 5 is a view, in perspective, of the contamination control device as shown in FIG. 4.

It has been unexpectedly found that acting on the airstream flow in the area of the mixer 24 much more effectively and efficiently removes airborne particulate material from the airstream. The airstream of particulate material flow for this arrangement is particularly shown in FIG. 2 as designated by the letter F. A contamination control device 60 is provided, as best shown in FIGS. 2, 4, and 5. The contamination control device 60 includes an elongated tube 110 attached to the outer portion of the housing 12 of the development station 10 (similar to the arrangement of FIG. 3). The tube 110 has a plurality of ports 112 communicating with the interior of the tube. The ports 112 are located at spaced intervals along a longitudinal element of the tube (see FIG. 5). A vacuum source V (see FIG. 1) is coupled to the tube 110 to draw air into the tube through the ports 112. The coupling of the tube 110 to the vacuum source V may be accomplished via a conduit 114 terminating adjacent to the end 110*a* of the tube. The conduit is located relative to the development station 10, when the station is properly operatively positioned within the reproduction apparatus, so as to automatically connect the conduit (and thus the vacuum source) to the tube when the development station is installed in the reproduction apparatus.

In contradistinction to the arrangement of the prior art, the ports 112 are directed toward the mixer 24. The housing 12 of the development station includes openings 116 communicating with the ports 112. Accordingly, the vacuum source V is effective to draw air from the area of the mixer 24 through the openings 116 and the ports 112 into the tube 110 where it can be directed via the conduit 114 to a downstream contained collection chamber (not shown) to capture the particulate material. Since the air in the area of the mixer 24 is the portion of the airstream flow F most laden with particulate material, the described arrangement of the contamination control device 60 is the most effective and efficient at capturing and removing the particulate material. Thus, when the airstream flow F reaches the toning zone T (and beyond), after being subjected to the contamination control collection device 60 of this invention, it is more uniformly clean than with any arrangement previously found in the prior art. Therefore, the reproduction apparatus and its environment remain substantially uncontaminated.

The invention has been described in detail with particular reference to preferred embodiment thereof, but it will be understood that variations and modifications can be effected within the spirit and scope of the invention as set forth in the claims.

What is claimed is:

1. A development station for an electrostatographic reproduction apparatus wherein pigmented marking particles from a particulate material mixture of pigmented marking particles and magnetic carrier particles are utilized to develop latent image charge patterns on a dielectric member, said development station comprising:

a housing adapted to be located adjacent to a dielectric member, said housing defining a reservoir for a particulate material mixture, said housing further defining an opening facing such dielectric member;

means, located within said housing, for mixing such particulate material;

magnetic brush means, located adjacent to said opening defined in said housing, for applying pigmented marking particles from such particulate material mixture to a latent image charge pattern to develop such charge pattern;

means, located within said housing, for transporting such particulate material from said mixing means to said magnetic brush means; and means, located externally of said housing, associated with said housing and communicating with the interior thereof between said magnetic brush means and said mixing means, for collecting airborne particulate material to substantially prevent contamination of the reproduction apparatus and its environment.

2. The development station of claim 1 wherein said collecting means includes an elongated tube supported by said housing, said tube defining an opening through the wall of said tube communicating with the interior of said tube; means in said housing for defining passages communicating with said opening of said tube; and means for supplying a vacuum to the interior of said tube.

3. The development station of claim 2 wherein said opening through the wall of said tube includes a plurality of ports.

4. The development station of claim 3 wherein said ports of said plurality of ports are respectively spaced at intervals along a longitudinal element of said tube.

5. For use with a development station for an electrostatographic reproduction apparatus wherein pigmented marking particles from a particulate material mixture of pigmented marking particles and magnetic carrier particles are utilized to develop latent image charge patterns on a dielectric member, said development station having a housing adapted to be located adjacent to a dielectric member, said housing defining a reservoir for a particulate material mixture, said housing further defining an opening facing such dielectric member, means for mixing such particulate material, magnetic brush means for applying pigmented marking particles from such particulate material mixture to a latent image charge pattern to develop such charge pattern, means for transporting such particulate material from said mixing means to said magnetic brush means, and a device for collecting contaminating airborne particulate material contamination, said contamination collecting device comprising:

an elongated tube, associated with said housing and located externally thereof, said tube defining an opening communicating through the wall of said tube with the interior thereof; means in said housing for defining passages between said magnetic brush means and said mixing means communicating with said opening of said tube; and means for supplying a vacuum to the interior of said tube to prevent contamination of the reproduction apparatus and its environment.

6. The development station contamination collecting device of claim 5 wherein said elongated tube is supported by said housing.

7. The development station contamination collecting device of claim 6 wherein said opening through the wall of said tube includes a plurality of ports.

8. The development station contamination collecting device of claim 7 wherein said ports of said plurality of ports are respectively spaced at intervals along a longitudinal element of said tube.

* * * * *

UNITED STATES PATENT AND TRADEMARK OFFICE

CERTIFICATE OF CORRECTION

PATENT : 5,881,338

DATED : March 9, 1999

INVENTOR(S) : Armstrong et al.

It is certified that error appears in the above-identified patent and that said Letters Patent is hereby corrected as shown below:

On the title page, insert the following item:
--[60] Provisional Application No. 60/000,637 filed Jun. 29, 1995--.

Column 1, line 4, insert the following:

--CROSS REFERENCE TO RELATED APPLICATION
Reference is made to and priority claimed from U.S. Provisional Application Serial No. US 60/000637, filed Jun. 29, 1995, entitled CONTAMINATION CONTROL DEVICE FOR AND ELECTROSTATOGRAPHIC DEVELOPMENT STATION--.

Signed and Sealed this

Eleventh Day of January, 2000

*Attest:*

*Attesting Officer*

Q. TODD DICKINSON

*Acting Commissioner of Patents and Trademarks*